United States Patent [19]

Inumaru et al.

[11] Patent Number: 4,676,830

[45] Date of Patent: Jun. 30, 1987

[54] HIGH STRENGTH MATERIAL PRODUCED BY CONSOLIDATION OF RAPIDLY SOLIDIFIED ALUMINUM ALLOY PARTICULATES

[75] Inventors: Susumu Inumaru, Nagoya; Shigenori Yamauchi, Aichi; Kazuhisa Shibue, Toyoake; Hideo Sano; Kiyofumi Ito, both of Nagoya, all of Japan

[73] Assignee: Sumitomo Light Metal Industries, Ltd., Tokyo, Japan

[21] Appl. No.: 763,373

[22] Filed: Aug. 7, 1985

[30] Foreign Application Priority Data

Aug. 13, 1984 [JP] Japan ..... 59-167935

[51] Int. Cl.[4] ..... C22C 1/00

[52] U.S. Cl. ..... 75/249; 419/23; 419/25; 419/67; 420/551

[58] Field of Search ..... 75/249; 420/538, 551; 419/23, 25, 67

[56] References Cited

U.S. PATENT DOCUMENTS

| | | | |
|---|---|---|---|
| 2,963,780 | 12/1960 | Lyle et al. | 75/249 |
| 2,973,570 | 3/1961 | Nachtman | 75/249 |
| 3,380,820 | 4/1968 | Hetke et al. | 75/249 |
| 3,964,935 | 6/1976 | Wilks | 75/249 |
| 4,347,076 | 8/1982 | Ray et al. | 75/249 |
| 4,464,199 | 8/1984 | Hildeman | 75/249 |

FOREIGN PATENT DOCUMENTS

| | | | |
|---|---|---|---|
| 729122 | 3/1966 | Canada | 75/249 |
| 136508 | 4/1985 | European Pat. Off. | 75/249 |
| 56-90903 | 7/1981 | Japan . | |
| 2088409 | 6/1982 | United Kingdom . | |

*Primary Examiner*—Stephen J. Lechert, Jr.

*Attorney, Agent, or Firm*—Flynn, Thiel, Boutell & Tanis

[57] ABSTRACT

A superior high-temperature strength aluminum alloy material is produced by consolidating rapdily solidified particulates of an aluminum alloy into a desired configuration, the aluminum alloy consisting of, in weight percentages, 4 to 15% Fe, and 0.5 to 8% V and the balance being essentially aluminum. The aluminum alloy may further contain at least one element selected from the group consisting of 0.5 to 8% Mo, 0.5 to 8% Ni, 0.3 to 8% Zr and 0.5 to 8% Ti and these additional components develop a further increased strength in the resulting formed materials. Since the consolidated aluminum materials above specified have a superior strength at high temperatures as well as moderate temperature without an expensive Ce, they are highly useful as economical heat-resistant materials for various applications, particularly for the fields where high strength at high temperatures and lightness of weight are required.

6 Claims, No Drawings

HIGH STRENGTH MATERIAL PRODUCED BY CONSOLIDATION OF RAPIDLY SOLIDIFIED ALUMINUM ALLOY PARTICULATES

BACKGROUND OF THE INVENTION

The present invention relates to aluminum alloy materials produced by means of powder metallurgical technique and more particularly to formed materials having a high strength at high temperatures as well as moderate temperatures, the materials being produced by consolidating aluminum alloy particulates rapidly solidified in atomization or other conventional processes into a desired configuration by extrusion, rolling, forging, sintering, hot isostatic pressing or other usual forming processes.

In the field of the manufacture of connecting rods for automobile engines, impellers or fan blades for gas turbines, structural components for supersonic airplanes, etc, heat resistant materials having a high strength at the high temperature range of 100° to 400° C. have been required. If the materials used in such fields are made of aluminum alloys, great advantages will be expected by virtue of their lightness of weight. However, the conventional aluminum alloys can not be used in such applications, since their strength is considerably reduced at the temperatures higher than 150° C.

Recently, some kinds of Al-Fe system alloys such as Al-8Fe-4Ce, Al-8Fe-2Co and Al-8Fe-2Mo, which are produced by the process including rapid solidification and consolidation, have been proposed as heat resistant aluminum alloys. However, these conventional materials do not always provide satisfactory utility in the practical use. For example, the foregoing Al-8Fe-4Ce material increases the cost of the finished products because of the addition of expensive Ce. Further, the materials of Al-8Fe-2Co alloy and Al-8Fe-2Mo alloy can not always give an adequate high-temperature strength in practical use.

SUMMARY OF THE INVENTION

It is therefore an object of the present invention to eliminate the above disadvantages encountered in the heretofore known materials formed from the foregoing rapidly solidified aluminum alloys, i.e., Al-8Fe-4Ce, Al-8Fe-2Co or Al-8Fe-2Mo. More specifically, the object of the present invention is to provide aluminum alloy materials formed from rapidly solidified aluminum alloy particulates with novel compositions, in which their strength at high temperatures is considerably increased by a fine dispersion of primary phase and/or precipitates of iron-containing intermetallic compounds having a size of not greater than 5 μm, without using expensive cerium (Ce).

According to the present invention, there is provided a superior high-temperature strength aluminum alloy material which is strengthened by primary phase and/or precipitates of iron-containing intermetallic compounds with a fine size not greater than 5 μm, the material being produced by consolidating the rapidly solidified particulates of aluminum alloy (1) or (2) of the following novel compositions, expressed, in weight percentages, into a desired form in a usual manner.

Aluminum alloy (1)

Fe: from 4 to 15%

V: from 0.5 to 8%, and the balance being essentially aluminum.

Aluminum alloy (2)

Fe: from 4 to 15%

V: from 0.5 to 8%, at least one element selected from the group consisting of

Mo: from 0.5 to 8%,

Ni: from 0.5 to 8%,

Zr: from 0.3 to 8% and

Ti: from 0.5 to 8%, and the balance being essentially aluminum.

Since the aluminum materials specified above exhibit a high strength at high temperatures as well as moderate temperatures without using expensive Ce, they are highly useful as economical heat-resistant materials for various applications, particularly for the fields where high strength at high temperatures and light weight are desirable.

DETAILED DESCRIPTION OF THE PREFERRED EMBODIMENTS

As described above, the present invention resides in the provision of high-temperature strength aluminum alloy materials not containing an expensive Ce which are produced by consolidating the rapidly solidified aluminum alloy (1) or (2) having the novel composition specified above.

Now, the function of each alloying element of the rapidly solidified alloys (1) and (2) will be described in detail with reference to its content range.

Fe: Fe-containing intermetallic compounds are dispersed in the matrix as fine primary phases during rapid solidification and/or as fine precipitates during consolidation with a fine size not greater than 5 μm. Such a fine dispersion of the intermetallic compounds lead to a substantial increase in strength at elevated temperatures and moderate temperatures in the formed materials. When the Fe content is less than 4 wt. %, this effect is inadequate. On the other hand, even if Fe is contained in an excess amount over 15 wt. %, the effect can not be further increased, because it is saturated.

V: This component refines the foregoing Fe-bearing intermetallic compounds and enhances the strengthening effect of Fe. Thus, formed aluminum alloys containing V have a further increased strength at moderate temperatures and high temperatures as compared to Al-Fe binary alloys. However, when the content of V is less than 0.5 wt. %, this effect can not be sufficiently obtained. On the other hand, an excess addition of V beyond its upper limit, i.e., 8 wt. %, can not provide any further increased effect, because the effect reaches the maximum level and unfavorably leads to an increase in cost.

Mo, Ni, Zr and Ti: These components can be added solely or in combination thereof to the Al-Fe-V alloy material (1) and thereby the finer dispersion of the foregoing intermetallic compounds can be achieved and the strengthening effect is further increased in the material formed from the alloy (2) both at moderate temperatures and high temperatures.

When Mo, Ni, and Ti are each less than 0.5 wt. % and Zr is less than 0.3 wt. %, this effect can not be adequately obtained. On the other hand, even if each of these components is added in an excess amount more than 8 wt. %, this effect can not be further increased, since the effect reaches the saturation level. The excess addition leads only to an increase in cost.

Hereinafter, examples of the present invention are given together with comparative examples.

EXAMPLES

Alloys 1 to 19 given in Table 1 were melted and rapidly solidified powders with an average diameter of 60 μm were produced by He gas atomization process. The cooling rate in the process is approximately from $10^3$ to $10^4$ °C./sec.

Thereafter, the powders thus obtained from each alloy composition were formed into a rod shape with a diameter of 18 mm in the following procedures: cold compaction of the alloy powders until 70 to 80% of theoretical density, packing the compacted alloy powders in an aluminum can, vacuum degassing at an elevated temperature of 400° C. and then extruding into a rod shape with a diameter of 18 mm.

On the other hand, a comparative alloy 20 was melted and then cast into an ingot having a diameter of 152 mm by a continuous casting process (cooling rate: less than 10° C./sec). Thereafter, the ingot was extruded into a rod with a diameter of 40 mm at 400° C. and then solution heat treated for 24 hours at 530° C. After solution heat treating, the alloy rod was cooled with hot water and subsequently was subjected to an aging treatment for 20 hours at 200° C. (T6 type heat treatment).

The alloy rods thus obtained were subjected to the tensile test at room temperature and 250° C. (holding time: 100 Hrs). The test results are given in Table 2 in which the numbers of the alloy rods indicated in Table 2 correspond to the numbers of the alloys in Table 1, respectively.

TABLE 1

(Composition of Alloys)

| Alloy No. | Chemical Composition (wt. %) Fe | V | Mo | Ni | Zr | Ti | Ce | Co | Al |
|---|---|---|---|---|---|---|---|---|---|
| 1 | 4.6 | 4.5 | | | | | | | bal. |
| 2 | 8.3 | 2.2 | | | | | | | bal. |
| 3 | 12.1 | 0.9 | | | | | | | bal. |
| 4 | 11.9 | 3.1 | | | | | | | bal. |
| 5 | 7.9 | 2.3 | 2.0 | | | | | | bal. |
| 6 | 8.0 | 2.1 | | 2.2 | | | | | bal. |
| 7 | 8.2 | 1.9 | | | 1.3 | | | | bal. |
| 8 | 8.2 | 2.0 | | | | 2.1 | | | bal. |
| 9 | 8.5 | 1.8 | 0.7 | 0.6 | | | | | bal. |
| 10 | 7.7 | 2.5 | 0.5 | | 0.4 | | | | bal. |
| 11 | 7.8 | 0.6 | 3.9 | | | 0.9 | | | bal. |
| 12 | 8.0 | 0.7 | | 0.9 | 3.0 | | | | bal. |
| 13 | 8.1 | 1.0 | | 1.0 | | 3.3 | | | bal. |
| 14 | 8.1 | 1.5 | | | 0.6 | 2.1 | | | bal. |
| 15 | 9.0 | 0.5 | 0.5 | 3.2 | 0.5 | | | | bal. |
| 16 | 8.5 | 1.1 | 0.5 | 1.0 | 1.0 | 0.6 | | | bal. |
| 17 | 8.0 | | 2.0 | | | | | | bal. |
| 18 | 7.9 | | | | | | 4.0 | | bal. |
| 19 | 7.9 | | | | | | | 2.1 | bal. |
| 20* | Al—2.3Cu—1.6Mg—1.0Fe—1.1Ni—0.2Si | | | | | | | | |

*AA2618 (produced by ingot metallurgy process)
Nos. 1 to 16: Examples of the present invention
Nos. 17 to 20: Comparative Examples

TABLE 2

(Mechanical Properties of Alloy Rods)

| Rod No. | Room Temperature $\sigma_{0.2}$ | $\sigma_\beta$ | δ | 250° C. (Holding Time: 100 Hrs) $\sigma_{0.2}$ | $\sigma_\beta$ | δ |
|---|---|---|---|---|---|---|
| 1 | 30.5 | 39.1 | 11 | 21.7 | 25.9 | 10 |
| 2 | 32.6 | 40.9 | 10 | 22.2 | 26.7 | 10 |
| 3 | 33.8 | 42.0 | 9 | 22.5 | 26.9 | 9 |
| 4 | 34.1 | 45.6 | 9 | 23.0 | 27.1 | 9 |
| 5 | 33.3 | 44.7 | 9 | 24.9 | 30.6 | 9 |
| 6 | 38.9 | 46.1 | 6 | 25.9 | 28.9 | 7 |
| 7 | 43.3 | 51.6 | 4 | 33.4 | 37.0 | 6 |
| 8 | 38.9 | 46.3 | 6 | 24.9 | 29.0 | 7 |
| 9 | 33.1 | 44.5 | 9 | 24.7 | 29.9 | 9 |
| 10 | 32.9 | 43.0 | 9 | 24.6 | 30.1 | 9 |
| 11 | 33.9 | 45.3 | 8 | 24.9 | 29.1 | 7 |
| 12 | 43.8 | 52.1 | 4 | 23.8 | 28.0 | 7 |
| 13 | 34.0 | 45.3 | 7 | 26.0 | 31.3 | 7 |
| 14 | 33.8 | 44.7 | 8 | 24.8 | 30.2 | 8 |
| 15 | 40.3 | 48.2 | 6 | 24.7 | 30.0 | 8 |
| 16 | 34.4 | 45.7 | 7 | 24.5 | 28.6 | 7 |
| 17 | 29.1 | 37.9 | 14 | 18.9 | 23.6 | 14 |
| 18 | 28.2 | 38.1 | 9 | 19.0 | 25.4 | 9 |
| 19 | 24.0 | 33.8 | 12 | 16.2 | 20.3 | 15 |
| 20* | 36.8 | 44.5 | 10 | 19.1 | 21.5 | 24 |

*AA2618-T6
$\sigma_{0.2}$: Yield Strength (kgf/mm$^2$)
$\sigma_\beta$: Tensile Strength (kgf/mm$^2$)
δ: Elongation (%)
Nos. 1 to 16: Examples of the present invention
Nos. 17 to 20: Comparative Examples It can be seen clearly from Table 2 that the formed products 1 to 16 of the present invention are superior in their mechanical strength both at room temperature and the elevated temperature to the conventional alloy products 17 to 19. Although the alloy rods 1 and 2 exhibit only slightly higher strength than that of the comparative alloy rod 18, but as will be noted from the comparison of the costs of vanadium and cerium, the invention products 1 and 2, are more economical. Such economical advantages make the invention products commercially valuable and highly useful for practical uses. Further, the alloy rods 1 to 16 according to the present invention are far superior in their strength at high temperatures as compared with alloy rod No. 20 which is made of a typical heat-resistant alloy by means of ingot metallurgy process.

According to the present invention, the following beneficial effects can be obtained.

(1) In comparison with conventional materials for high temperature service which are formed from rapidly solidified aluminum alloy particulates containing Ce, the consolidated materials exhibiting a high strength at high temperatures can be produced from Ce-free aluminum alloys at a substantially reduced cost, according to the present invention.

(2) The consolidated materials of the present invention exhibit a more superior high-temperature strength than the materials formed from conventional aluminum alloys, Al-8Fe-2Co or Al-8Fe-2Mo alloys, especially at high temperatures.

(3) The consolidated materials obtained by the present invention can be employed in high temperature environments, especially at temperatures not lower than 150° C., where the conventional heat-resistant aluminum alloy materials produced by means of ingot metallurgy process can not be successfully employed. Thus, the materials of the present invention make possible a significant reduction in weight and provide technical and economical advantages in various applications.

What is claimed is:

1. A high-strength material produced by consolidating rapidly solidified particles of an aluminum alloy, said aluminum alloy consisting essentially of, in weight percentages:

Fe: 4–15%;
V: 0.5–8%;
Mo: 0.5–8%;
Zr: 0.3–8%;
at least one member of the group consisting of:

Ni: 0.5–8% and

Ti: 0.5–8%; and the balance being essentially aluminum, said aluminum alloy being strengthened by a fine dispersion of Fe-containing intermetallic compounds having a size of 5 μm and less.

2. A high-strength material according to claim 1 in which said rapidly solidified particles have been produced by atomizing and solidifying, at a cooling rate of $10^3$ to $10^4$ °C./sec, a melt of said aluminum alloy, using a gas.

3. A high-strength material produced by consolidating rapidly solidified particles of an aluminum alloy, said alloy consisting essentially of, in weight percentages:

Fe: 4–15%;

V: 0.5–8%;

Mo: 0.5–8%;

Zr: 0.3–8%;

the balance being essentially aluminum, said aluminum alloy being strengthened by a fine dispersion of Fe-containing intermetallic compounds having a size of 5 μm and less.

4. A high-strength material according to claim 3 in which said rapidly solidified particles have been produced by atomizing and solidifying, at a cooling rate of $10^3$ to $10^4$ °C./sec, a melt of said aluminum alloy, using a gas.

5. A high-strength material as claimed in claim 1, wherein consolidation of the rapidly solidified particles comprises cold compaction of the solidified particles of said aluminum alloy to 70–80% of the theoretical density thereof, packing the compacted alloy particles into a form, vacuum degassing the compacted alloy particles at an elevated temperature of 400° C. and extruding the thus-formed high-strength material.

6. A high-strength material as claimed in claim 3, wherein consolidation of the rapidly solidified particles comprises cold compaction of the solidified particles of said aluminum alloy to 70–80% of the theoretical density thereof, packing the compacted alloy particles into a form, vacuum degassing the compacted alloy particles at an elevated temperature of 400° C. and extruding the thus-formed high-strength material.

* * * * *